US011014771B2

(12) United States Patent
Kawamoto et al.

(10) Patent No.: US 11,014,771 B2
(45) Date of Patent: May 25, 2021

(54) MEDIUM TRANSPORT DEVICE AND IMAGE FORMING APPARATUS

(71) Applicant: FUJI XEROX CO., LTD., Tokyo (JP)

(72) Inventors: Hiroshi Kawamoto, Kanagawa (JP); Riwako Miyauchi, Kanagawa (JP); Kiminobu Tsutada, Kanagawa (JP); Masato Minagawa, Kanagawa (JP); Tomohiro Ueno, Kanagawa (JP); Satoshi Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 232 days.

(21) Appl. No.: 16/384,945

(22) Filed: Apr. 16, 2019

(65) Prior Publication Data

US 2020/0102175 A1 Apr. 2, 2020

(30) Foreign Application Priority Data

Sep. 28, 2018 (JP) ..... JP2018-183479

(51) Int. Cl.

| | |
|---|---|
| ***B65H 29/60*** | (2006.01) |
| ***B65H 5/36*** | (2006.01) |
| ***G03G 15/00*** | (2006.01) |
| ***B65H 29/58*** | (2006.01) |

(52) U.S. Cl.

CPC ..... *B65H 29/60* (2013.01); *B65H 5/36* (2013.01); *B65H 29/58* (2013.01); *G03G 15/6529* (2013.01); *B65H 2404/632* (2013.01); *B65H 2555/13* (2013.01); *B65H 2801/06* (2013.01)

(58) Field of Classification Search

CPC ..... B65H 29/60; B65H 29/58; B65H 5/36; B65H 2404/63; B65H 2404/631; B65H 2404/632; B65H 2404/633; G07D 11/18; B41J 13/009; G03G 15/6529

See application file for complete search history.

(56) References Cited

U.S. PATENT DOCUMENTS

| | | | | |
|---|---|---|---|---|
| 6,128,463 | A | 10/2000 | Matsumoto et al. | |
| 8,340,566 | B2 * | 12/2012 | Jeong | G03G 15/6552 399/401 |
| 8,387,980 | B2 * | 3/2013 | Kang | B41J 13/009 271/303 |

(Continued)

FOREIGN PATENT DOCUMENTS

| | | |
|---|---|---|
| JP | H10167543 | 6/1998 |
| JP | 2017119559 | 7/2017 |

*Primary Examiner* — Jeremy R Severson

(74) *Attorney, Agent, or Firm* — Volpe Koenig

(57) ABSTRACT

A medium transport device includes a transporting member that transports a medium toward a medium accommodating member; a switching member that switches between a first guide position, in which the switching member guides the medium to be transported to the medium accommodating member, and a second guide position, in which the switching member guides the medium to be transported to a position different from the medium accommodating member, the switching member being movable between a first shift position and a second shift position in a width direction of the medium; and a movement member that moves the switching member to the first guide position to move the switching member to the first shift position, and that moves the switching member to the second guide position to move the switching member to the second shift position.

19 Claims, 6 Drawing Sheets

(56) References Cited

U.S. PATENT DOCUMENTS

| | | | | |
|---|---|---|---|---|
| 10,005,630 | B2 * | 6/2018 | Shiina | B65H 3/06 |
| 2006/0204287 | A1 * | 9/2006 | Konagaya | G03G 15/50 399/296 |

* cited by examiner

MEDIUM TRANSPORT DEVICE AND IMAGE FORMING APPARATUS

CROSS-REFERENCE TO RELATED APPLICATIONS

This application is based on and claims priority under 35 USC 119 from Japanese Patent Application No. 2018-183479 filed Sep. 28, 2018.

BACKGROUND

(i) Technical Field

The present disclosure relates to a medium transport device and an image forming apparatus.

(ii) Related Art

Japanese Patent Application Publication No. 2017-119559 ([0025] to [0043], and FIGS. 2 and 3) and Japanese Patent Application Publication No. 10-167543 ([0041] to [0061], and FIGS. 2, 5, and 6) describe known technologies relating to image forming apparatuses, such as a copying machine, a printer, or a FAX machine, including a switching device for switching the direction in which media are transported.

Japanese Patent Application Publication No. 2017-119559 describes a switching member (181), which switches between a first switch position, in which it guides a sheet to be discharged to a paper output tray (121) and a sheet to be transported to a double-sided printing transport path (206) for double-side printing, and a second switch position, in which it guides a sheet to a sheet reversing transport path (202) for double-side printing, to change the transport path. In Japanese Patent Application Publication No. 2017-119559, the switching member (181) is moved to and held in the first switch position with an urging force of a torsion coil spring (214).

Japanese Patent Application Publication No. 10-167543 describes a structure including a first flap member (101) and a second flap member (102), which sort the sheets into a sheet reversing portion (52), a face-down stacker (42), and a face-up stacker (50). In the structure described in Japanese Patent Application Publication No. 10-167543, the second flap member (102) has its position changed by a manually-operable operation lever (103), and the first flap member (101) has its position switched by turning on or off of a plunger (104). The structure described in Japanese Patent Application Publication No. 10-167543 does not include a member, such as a spring, for holding the flap members (101 and 102) at specific positions.

SUMMARY

Aspects of non-limiting embodiments of the present disclosure relate to a technology for preventing a transport path for a medium from being switched as a result of a switching member being pushed by the medium.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a medium transport device that includes a transporting member, a switching member, and a movement member. The transporting member transports a medium toward a medium accommodating member. The switching member switches a direction in which the medium is transported between a first guide position, in which the switching member guides the medium to the medium accommodating member, and a second guide position, in which the switching member guides the medium to a position different from the medium accommodating member. The switching member is movable between a first shift position and a second shift position in a width direction of the medium. The movement member moves the switching member to the first guide position to move the switching member to the first shift position, and moves the switching member to the second guide position to move the switching member to the second shift position.

BRIEF DESCRIPTION OF THE DRAWINGS

Exemplary embodiments of the present disclosure will be described in detail based on the following figures, wherein:

FIG. 4A is a perspective view of the portion viewed from obliquely above, and FIG. 4B is a view of the portion viewed in the direction of arrow IVB in FIG. 4A;

FIG. 6A illustrates the gate in a first guide position, and FIG. 6B illustrates the gate in a second guide position.

DETAILED DESCRIPTION

With reference to the drawings, specific examples (referred to as examples, below) of exemplary embodiments of the present disclosure will be described. The present disclosure is not limited to the following examples.

For easy understanding of the following description, throughout the drawings, an X axis direction denotes the front-rear direction, a Y axis direction denotes the lateral direction, and a Z axis direction denotes the vertical direction. The directions or sides denoted with arrows X, −X, Y, −Y, Z, and −Z are respectively referred to as forward, rearward, rightward, leftward, upward, and downward, or a front side, a rear side, a right side, a left side, an upper side, and a lower side.

Throughout the drawings, an encircled dot denotes an arrow directing from the back to the front of the sheet, and an encircled cross denotes an arrow directing from the front to the back of the sheet.

In the description with reference to the drawings, components other than those needed for the description are appropriately omitted for ease of understanding.

EXAMPLE 1

Figure 1:
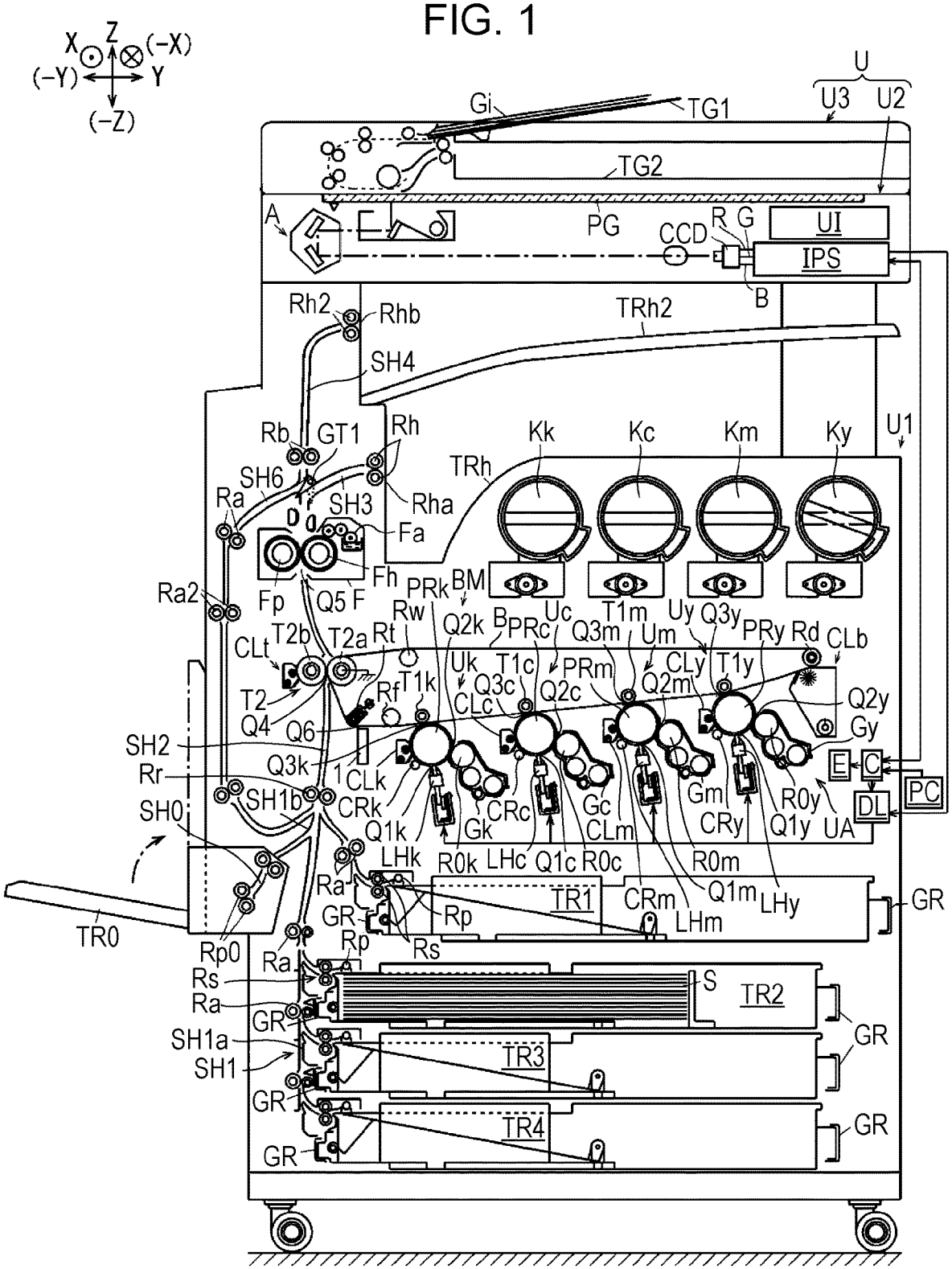
FIG. 1 illustrates the entirety of an image forming apparatus according to an example 1.

FIG. 1 illustrates the entirety of an image forming apparatus according to an example 1.

In FIG. 1, a copying machine U, which is an example of an image forming apparatus according to an example 1 of the present disclosure, includes a printer unit U1, which is an example of a recording unit and an example of an image recording device. The printer unit U1 supports, on its upper side, a scanner unit U2, which is an example of a reading unit and an example of an image reading device. The scanner unit U2 supports, on its upper side, an auto-feeder U3, which is an example of a document transporting device.

The auto-feeder U3 includes, at an upper portion, a document tray TG1, which is an example of a medium accommodating member. The document tray TG1 is capable of accommodating a stack of multiple documents Gi that are to be copied. A document output tray TG2, which is an example of a document discharge portion, is disposed below the document tray TG1. Document transport rollers U3*b* are disposed along a document transport path U3*a* connecting the document tray TG1 and the document output tray TG2.

On the upper surface of the scanner unit U2, a platen glass PG, which is an example of a transparent document table, is disposed. The scanner unit U2 according to the example 1 includes a reading unit U2*a*, which is an example of the reading unit, under the platen glass PG. The reading unit U2*a* according to the example 1 is supported to be movable in the lateral direction, which is an example of a sub-scanning direction, along the lower surface of the platen glass PG. The reading unit U2*a* is stationary in a normal state in an initial position drawn with a solid line in FIG. 1. The reading unit U2*a* is electrically connected to an image processor GS.

Figure 2:
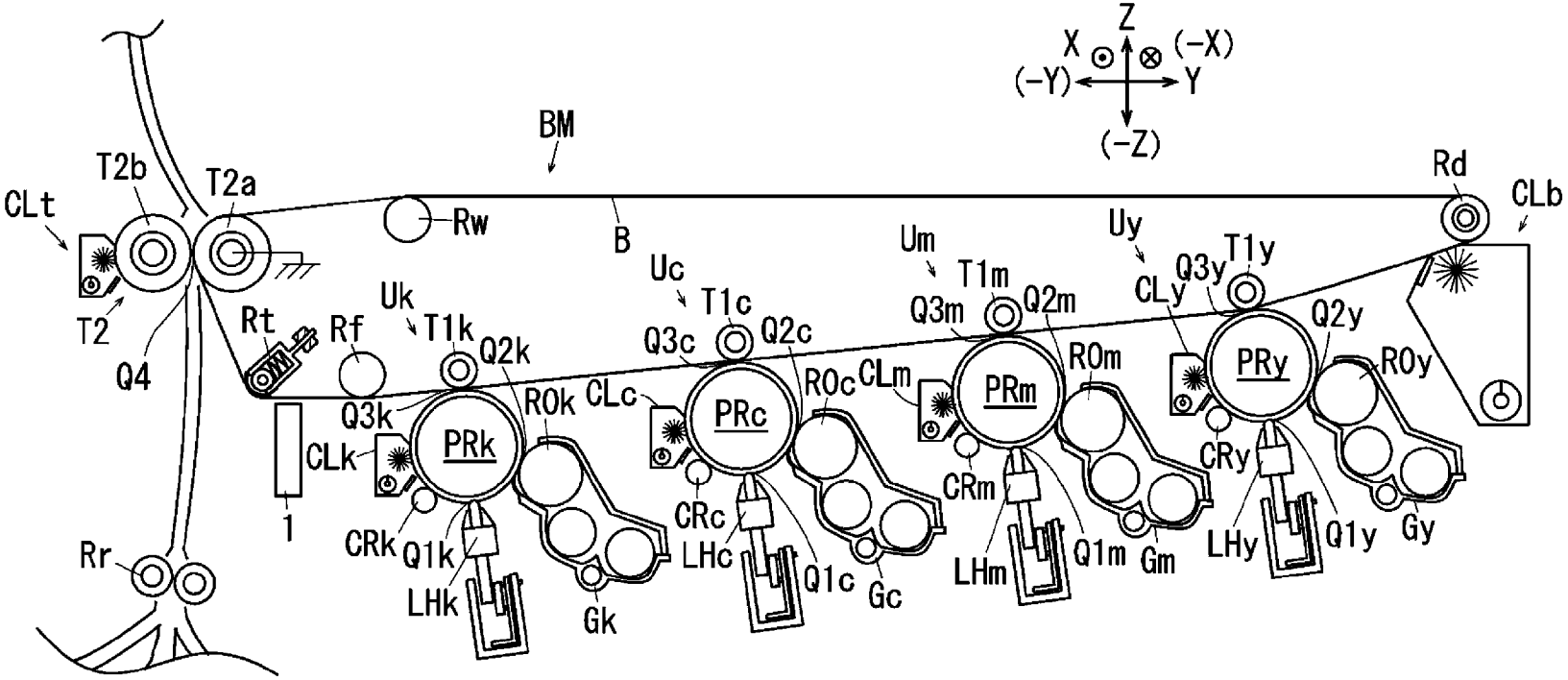
FIG. 2 illustrates a related portion of an image recording portion according to the example 1.

FIG. 2 illustrates a related portion of an image recording unit according to the example 1.

The image processor GS is electrically connected to a write circuit DL of the printer unit U1. The write circuit DL is electrically connected to an exposure devices LHy, LHm, LHc, and LHk, which are an example of a latent image forming member.

The exposure devices LHy to LHk according to the example 1 are formed from LED heads each including multiple LEDs arranged in the main scanning direction. The exposure devices LHy to LHk are capable of outputting write light, corresponding to the colors Y, M, C, and K in response to signals input from the write circuit DL.

The write circuit DL or a power circuit E has write timing or power feed timing controlled in accordance with control signals from a controller C, which is an example of a controller.

In FIG. 1, photoconductors PRy, PRm, PRc, and PRk, which are an example of an image carrier, are disposed above the exposure devices LHy to LHk. In FIGS. 1 and 2, the areas of the photoconductors PRy to PRk respectively irradiated with the write light constitute write areas Q1*y*, Q1*m*, Q1*c*, and Q1*k*.

Upstream of the write areas Q1*y* to Q1*k* in the rotation direction of the photoconductors PRy, PRm, PRc, and PRk, charging rollers CRy, CRm, CRc, and CRk, which are an example of a charging member, are disposed. The charging rollers CRy to CRk according to the example 1 are supported to be driven to rotate in contact with the photoconductors PRy to PRk.

Downstream of the write areas Q1*y* to Q1*k* in the rotation direction of the photoconductors PRy to PRk, developing devices Gy, Gm, Gc, and Gk, which are an example of a developing member, are disposed. The areas over which the photoconductors PRy to PRk and the developing devices Gy to Gk face each other constitute development areas Q2*y*, Q2*m*, Q2*c*, and Q2*k*.

Downstream of the developing devices Gy to Gk in the rotation direction of the photoconductors PRy to PRk, first transfer rollers T1*y*, T1*m*, T1*c*, and T1*k*, which are an example of a first transfer member, are disposed. The areas over which the photoconductors PRy to PRk and the first transfer rollers T1*y* to T1*k* face each other constitute first transfer areas Q3*y*, Q3*m*, Q3*c*, and Q3*k*.

Downstream of the first transfer rollers T1*y* to T1*k* in the rotation direction of the photoconductors PRy to PRk, photoconductor cleaners CLy, CLm, CLc, and CLk, which are an example of a cleaner, are disposed.

The photoconductor PRy, the charging roller CRy, the exposure device LHy, the developing device Gy, the first transfer roller T1*y*, and the photoconductor cleaner CLy for the color Y constitute an image forming unit Uy for the color Y, which is an example of a visible image forming member for the color Y according to the example 1 that forms toner images for the color Y. Similarly, the photoconductors PRm, PRc, and PRk, the charging rollers CRm, CRc, and CRk, the exposure devices LHm, LHc, and LHk, the developing devices Gm, Gc, and Gk, the first transfer rollers T1*m*, T1*c*, and T1*k*, and the photoconductor cleaners CLm, CLc, and CLk constitute image forming units Um, Uc, and Uk for the colors M, C, and K.

Above the photoconductors PRy to PRk, a belt module BM, which is an example of an intermediate transfer device, is disposed. The belt module BM is an example of an image carrier, and includes an intermediate transfer belt B, which is an example of an intermediate transfer member. The intermediate transfer belt B is formed from an endless belt member.

The intermediate transfer belt B according to the example 1 is rotatably supported by a tension roller Rt, which is an example of a tension member, a walking roller Rw, which is an example of an imbalance correcting member, an idler roller Rf, which is an example of a driven member, a backup roller T2*a*, which is an example of a member opposing the second transfer area, the first transfer rollers T1*y*, T1*m*, T1*c*, and T1*k*, and a driving roller Rd, which is an example of a driving member. In the example 1, the intermediate transfer belt B rotates when the driving roller Rd receives a driving force.

At the position opposing the backup roller T2*a* across the intermediate transfer belt B, a second transfer roller T2*b*, which is an example of a second transfer member, is disposed. The backup roller T2*a*, the second transfer roller T2*b*, and other components constitute a second transfer device T2 according to the example 1, which is an example of a transfer device. The area over which the second transfer roller T2*b* and the intermediate transfer belt B come into contact with each other forms a second transfer area Q4.

Downstream of the second transfer area Q4 in the rotation direction of the intermediate transfer belt B, a belt cleaner CLb, which is an example of a device for cleaning an intermediate transfer body, is disposed.

The first transfer rollers T1*y* to T1*k*, the intermediate transfer belt B, the second transfer device T2, and other components constitute a transfer device T1+T2+B according to the example 1, which is an example of a transfer member. The image forming units Uy to Uk and the transfer device T1+T2+B constitute an image recording unit Uy+Um+Uc+Uk+T1+T2+B according to the example 1.

In FIG. 1, below the image forming units Uy to Uk, four pairs of left and right guide rails GR, which are an example of a guide member, are disposed on four levels. Each guide rail GR supports a corresponding one of sheet feed trays TR1 to TR4, which are an example of a medium accommodating member, while allowing the sheet feed tray to be inserted thereinto or removed therefrom in the front-rear direction. The sheet feed trays TR1 to TR4 accommodate recording sheets S, which are an example of a medium.

On the upper left of each of the sheet feed trays TR1 to TR4, a pickup roller Rp, which is an example of a pickup member, is disposed. Downstream of each pickup roller Rp in the direction in which the recording sheets S are transported, separation rollers Rs, which are an example of a separation member, are disposed. Downstream of the separation rollers Rs in the direction in which the recording sheets S are transported, a sheet feed path SH1, which is an example of a medium transport path, extends upward. On the sheet feed path SH1, multiple transport rollers Ra, which are an example of a transport member, are disposed.

On the lower left of the copying machine U, a manual tray TR0, which is an example of a medium accommodating member, is disposed. On the upper right of the manual tray TR0, pickup rollers Rp0 are disposed, and a manual feed path SH0 extends from the pickup rollers Rp0. The manual feed path SH0 is merged with the sheet feed path SH1.

Registration rollers Rr, which are an example of a transport timing adjusting member, are disposed on the sheet feed path SH1 upstream of the second transfer area Q4. A transport path SH2 extends from the registration rollers Rr to the second transfer area Q4.

Downstream of the second transfer area Q4 in the direction in which the recording sheets S are transported, a fixing device F, which is an example of a fixing member, is disposed. The fixing device F includes a heating roller Fh, which is an example of a heating fixing member, and a pressing roller Fp, which is an example of a pressing fixing member. The area over which the heating roller Fh and the pressing roller Fp come into contact with each other constitutes a fixing area Q5.

On the upper surface of the printer unit U1, a lower paper output tray TRh, which is an example of a medium output portion, is disposed. A paper output path SH3, which is an example of a medium transport member, extends toward the lower paper output tray TRh above the fixing device F. At the downstream end of the paper output path SH3, output rollers Rh, which are an example of a medium transport member, are disposed.

Above the lower paper output tray TRh, an upper paper output tray TRh2, which is an example of a medium output portion, is disposed. Above the fixing device F, an upper transport path SH4, which diverges from the paper output path SH3, extends toward the upper paper output tray TRh2.

On the upper transport path SH4, reversing rollers Rb rotatable forward and rearward, which are an example of a medium transport member, are disposed. Above the point of divergence between the paper output path SH3 and the upper transport path SH4, a reverse path SH6, which is an example of a medium transport path, diverges downward to the left from the upper transport path SH4. A gate GT1, which is an example of a switching member, is disposed across the point of divergence between the paper output path SH3 and the upper transport path SH4 and the point of divergence between the upper transport path SH4 and the reverse path SH6. The gate GT1 is supported to be switchable between a first guide position (second position), at which it guides a recording sheet S from the fixing device F toward the lower paper output tray TRh and guides a recording sheet S from the upper transport path SH4 to the reverse path SH6, and a second guide position (first position), at which it guides a recording sheet S from the fixing device F to the upper transport path SH4.

On the reverse path SH6, multiple transport rollers Ra, which are an example of a medium transport member, are disposed. The reverse path SH6 has its downstream end merged to the sheet feed path SH1 at a portion upstream of the registration rollers Rr. Description of Image Forming Operation When an operator manually places a document Gi on the platen glass PG of the copying machine U according to the example 1 having the above structure for photocopying, the reading unit U2*a* moves in the lateral direction from the initial position to scan the document Gi on the platen glass PG while exposing the document Gi to light. When the auto-feeder U3 is used to automatically transport the documents Gi for photocopying, the reading unit U2*a* moves from the initial position to a document read position, indicated with a broken line in FIG. 1, and remains stationary. Thereafter, the multiple documents Gi accommodated in the document tray TG1 are sequentially transported to the document read position on the platen glass PG, and then passes the document read position to be discharged onto the document output tray TG2. The documents Gi that sequentially pass the read position on the platen glass PG are exposed to light and scanned by the stationary reading unit U2*a*. Light reflected off the documents Gi is received by the reading unit U2*a*. The reading unit U2*a* converts the received light reflected off the documents Gi into electric signals. To perform double-sided reading of a document Gi, a read sensor U3*d* also reads the document Gi.

The image processor GS receives electric signals output from the reading unit U2*a*. The image processor GS converts the electric signals of images of the colors R, G, and B read by the reading unit U2*a* into image information of yellow Y, magenta M, cyan C, and black K for latent image formation. The image processor GS outputs the converted image information to the write circuit DL of the printer unit U1. The image processor GS outputs the image information for only black K to the write circuit DL when an image is a single-color image, or a monochrome image.

The write circuit DL outputs control signals corresponding to the input image information to the exposure devices LHy to LHk. The exposure devices LHy to LHk output the write light corresponding to the control signals.

The photoconductors PRy to PRk rotate in response to the start of image formation. The charging rollers CRy to CRk receive a charging voltage from the power circuit E. Thus, the photoconductors PRy to PRk have their surfaces electrically charged by the charging rollers CRy to CRk. Electrostatic latent images are formed in the write areas Q1*y* to Q1*k* on the surfaces of the electrically charged photoconductors PRy to PRk with the laser beams Ly to Lk.

The electrostatic latent images on the photoconductors PRy to PRk are developed into toner images, which are an example of a visible image, by the developing devices Gy, Gm, Gc, and Gk in the development areas Q2*y* to Q2*k*.

The developed toner images are transported to the first transfer areas Q3*y*, Q3*m*, Q3*c*, and Q3*k*, at which they come into contact with the intermediate transfer belt B, which is an example of an intermediate transfer body. In the first transfer areas Q3*y*, Q3*m*, Q3*c*, and Q3*k*, the first transfer rollers T1*y* to T1*k* receive, from the power circuit E, a first transfer voltage having a polarity opposite to the polarity with which the toner is charged. Thus, the toner images on the photoconductors PRy to PRk are transferred to the intermediate transfer belt B by the first transfer rollers T1*y* to T1*k*. To form a multi-color toner image, a toner image on the downstream side is transferred to the intermediate transfer belt B to be superposed on a toner image that has been transferred to the intermediate transfer belt B in the upstream first transfer area.

Remnants or deposits left on the photoconductors PRy to PRk after a first transfer are respectively removed by the photoconductor cleaners CLy to CLk. The surfaces of the cleaned photoconductors PRy to PRk are respectively electrically recharged by the charging rollers CRy to CRk.

Single-color or multi-color toner images transferred onto the intermediate transfer belt B by the first transfer rollers T1*y* to T1*k* in the first transfer areas Q3*y* to Q3*k* are transported to the second transfer area Q4.

Recording sheets S on which images are to be recorded are picked up by the pickup roller Rp of an appropriate one of the sheet feed trays TR1 to TR4. The recording sheets S picked up by the pickup roller Rp while being stacked together are separated one from another by the separation rollers Rs. The recording sheets S separated by the separation rollers Rs are transported along the sheet feed path SH1 by the transport rollers Ra. The recording sheets S transported along the sheet feed path SH1 are fed to the registration rollers Rr. The recording sheets S placed on the manual tray TR0 are also fed to the sheet feed path SH1 through the manual feed path SH0 by the pickup rollers Rp0.

The registration rollers Rr transport a recording sheet S to the second transfer area Q4 at the timing when a toner image formed on the intermediate transfer belt B is transported to the second transfer area Q4. The second transfer roller T2*b* receives, from the power circuit E, a second transfer voltage having a polarity opposite to the polarity with which toner is charged. Thus, the toner image on the intermediate transfer belt B is transferred to the recording sheet S from the intermediate transfer belt B.

After the second transfer, the intermediate transfer belt B is cleaned by the belt cleaner CLb to remove deposits or other matters adhering to the surface.

The recording sheet S to which the toner image has been second-transferred is heated to have the toner image fixed while passing the fixing area Q5.

When the recording sheet S having an image fixed thereto is discharged to the lower paper output tray TRh, the gate GT1 is moved to the first guide position. The recording sheet S discharged from the fixing device F is thus transported along the paper output path SH3. The recording sheet S transported along the paper output path SH3 is discharged to the lower paper output tray TRh by the output rollers Rh.

When the recording sheet S is to be discharged to the upper paper output tray TRh2, the gate GT1 is moved to the second guide position to allow the recording sheet S to be discharged to the upper paper output tray TRh2.

When the recording sheet S is subjected to double-side printing, the gate GT1 is moved to the second guide position. When the recording sheet S has its trailing end passing the gate GT1, the gate GT1 is moved to the first guide position, and the reversing rollers Rb rotate rearward. Thus, the recording sheet S is guided to the gate GT1, and transported to the reverse path SH6.

Description of Gate Movement Mechanism

Figure 3:
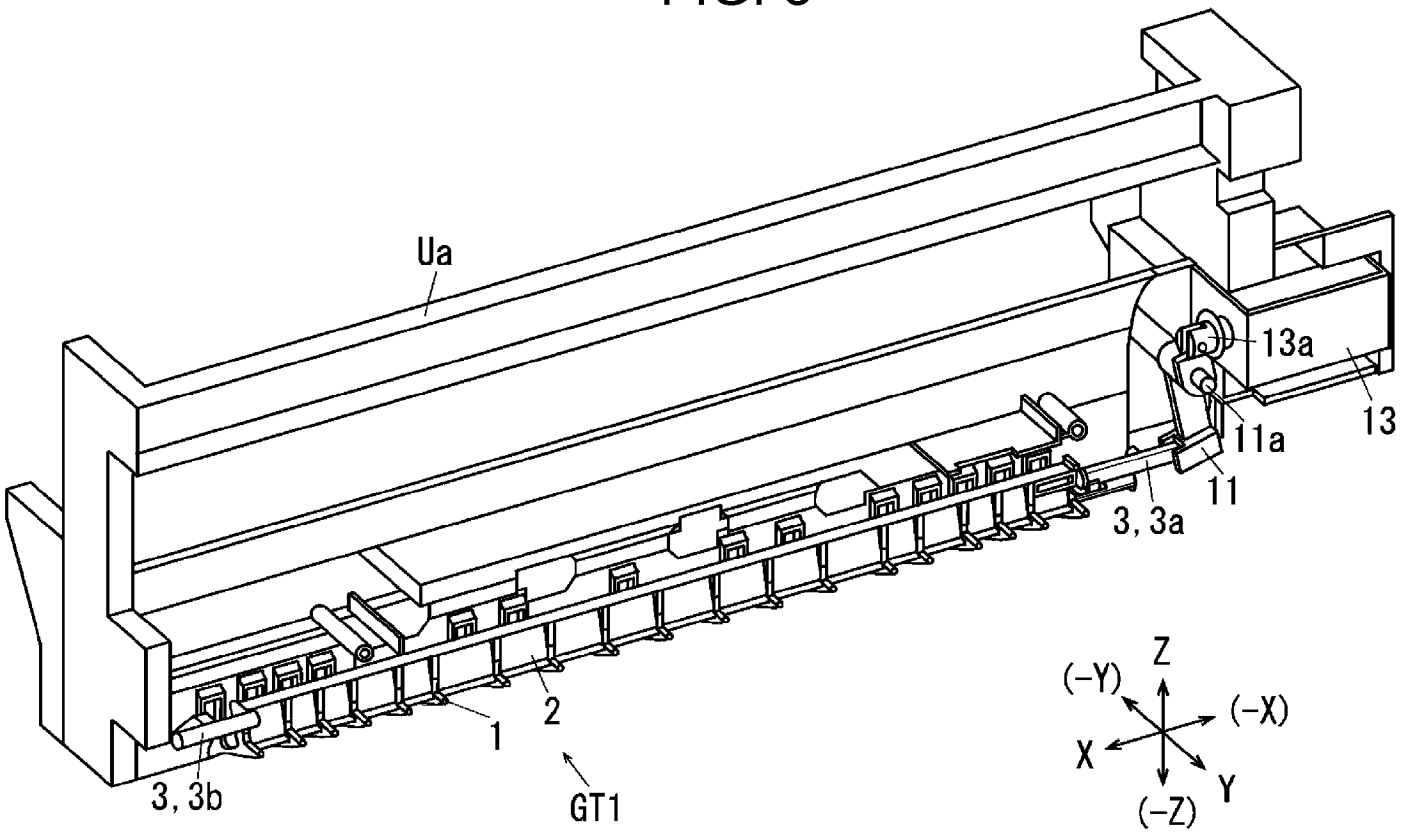
FIG. 3 illustrates a portion of a medium transport device according to the example 1.

FIG. 3 is a perspective view of a related portion of a medium transport device according to the example 1.

Figure 4A:
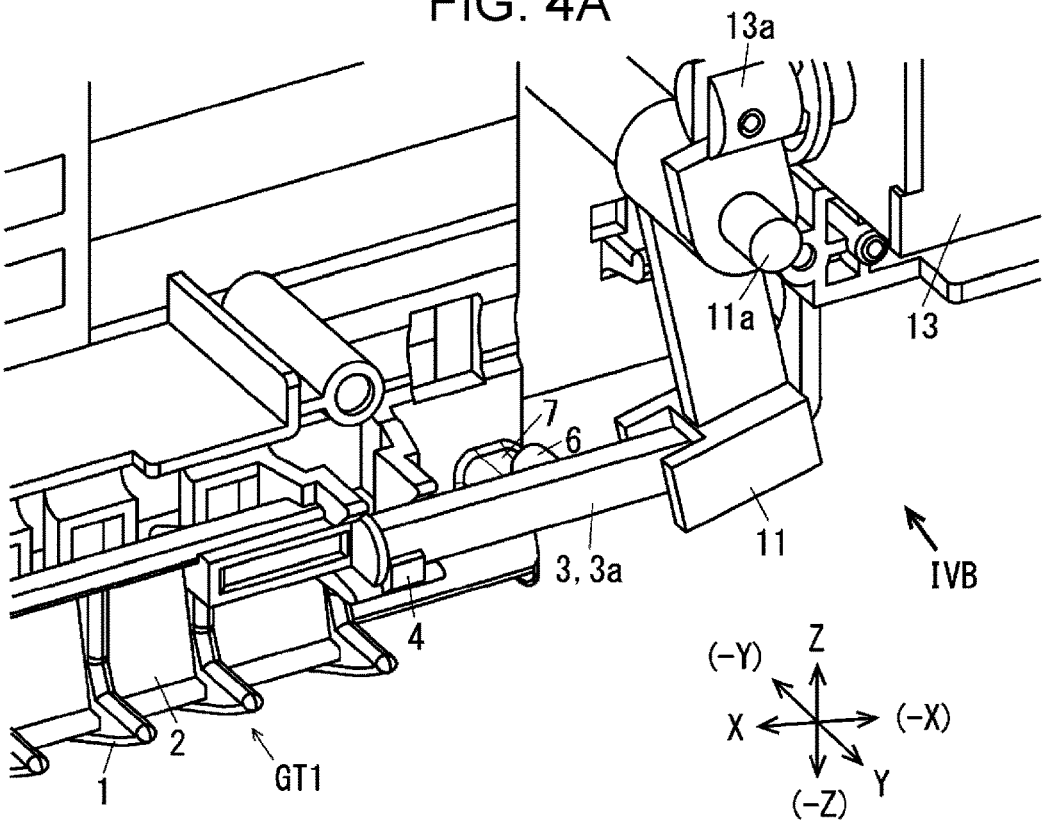
FIGS. 4A and 4B illustrate a related portion of a medium transport device according to the example 1 at a first end in a width direction, where
Figure 4B:
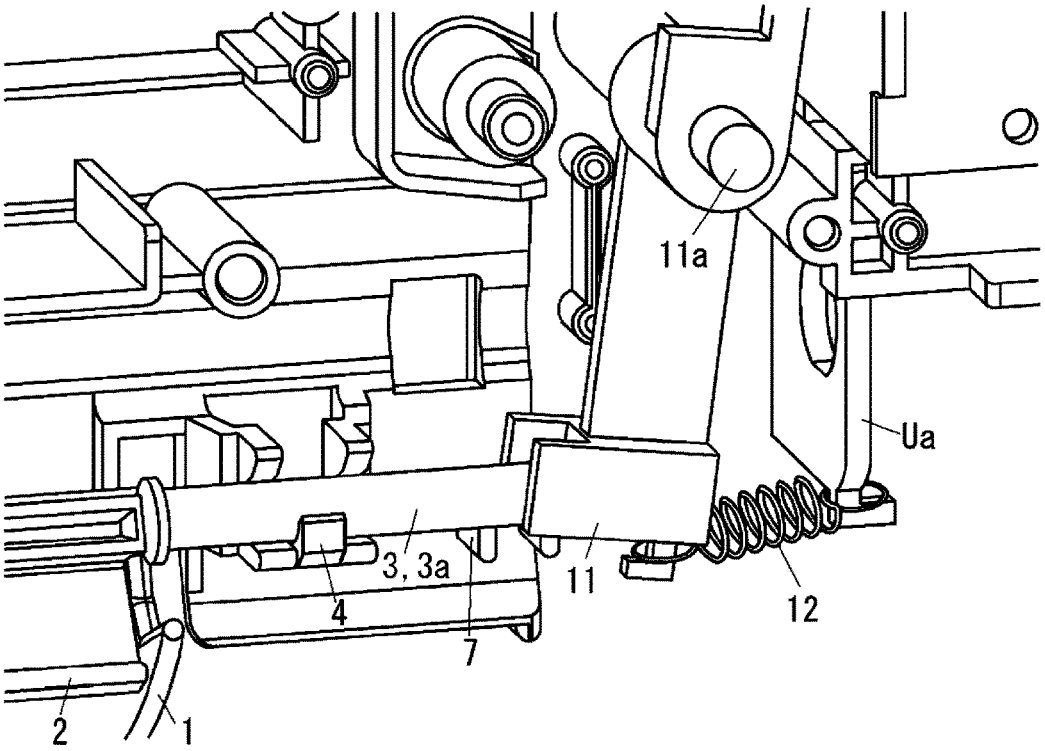

FIGS. 4A and 4B illustrate a portion of a medium transport device according to the example 1 at a first end in a width direction, where FIG. 4A is a perspective view of the portion viewed from obliquely above, and FIG. 4B is a view of the portion viewed in the direction of arrow IVB in FIG. 4A.

In FIGS. 3, 4A, and 4B, the gate GT1 according to the example 1 includes multiple plate-shaped gate bodies 1 arranged at intervals in the width direction of the recording sheet S. The gate bodies 1 are coupled together with a coupling portion 2, extending in the width direction of the recording sheet S. Shafts 3 are disposed at the outer ends of the coupling portion 2.

A rear shaft 3*a* is supported by a bearing 4 of a frame Ua to be rotatable and movable forward and rearward.

At the rear portion of the rear (closer to the first end) shaft 3*a*, a protruding portion 6, which is an example of a protruding member, is disposed. The protruding portion 6 is a circular cylinder extending leftward from the shaft 3*a*. Specifically, the protruding portion 6 has a curved outer surface.

The frame Ua has a guide protrusion 7, which is an example of a protruding contact member, on the left side of the protruding portion 6. The guide protrusion 7 has its outer surface chamfered into a curved surface. The guide protrusion 7 according to the example 1 has its front-rear length and its position determined to be contactable with the protruding portion 6 when the gate GT1 is moved to the rear (second shift position), and to be spaced from the protruding portion 6 in the front-rear direction when the gate GT1 is moved to the front (first shift position).

To the rear end of the rear shaft 3*a*, the lower end of a link 11, which is an example of the coupling member, is coupled.

The link 11 has its upper portion rotatably supported by a link shaft 11*a*, extending from the frame Ua. To the lower portion of the link 11, the first end of a gate spring 12, which is an example of an urging member, is coupled. The second end of the gate spring 12 is supported by the frame Ua.

To the upper end of the link 11, a plunger 13*a* of a solenoid 13, which is an example of a driving source, is coupled.

Thus, when the solenoid 13 is turned on (in operation), the upper end of the link 11 is pulled rearward, the lower end of the link 11 moves forward, and the gate GT1 moves forward (to the first shift position). When the solenoid 13 is turned off (stopped), the lower end of the link 11 is moved rearward with the elastic force of the gate spring 12, and the gate GT1 moves rearward (to the second shift position).

The components denoted with the reference signs 6 to 13 constitute a movement member 6 to 13 according to the example 1.

Figure 5:
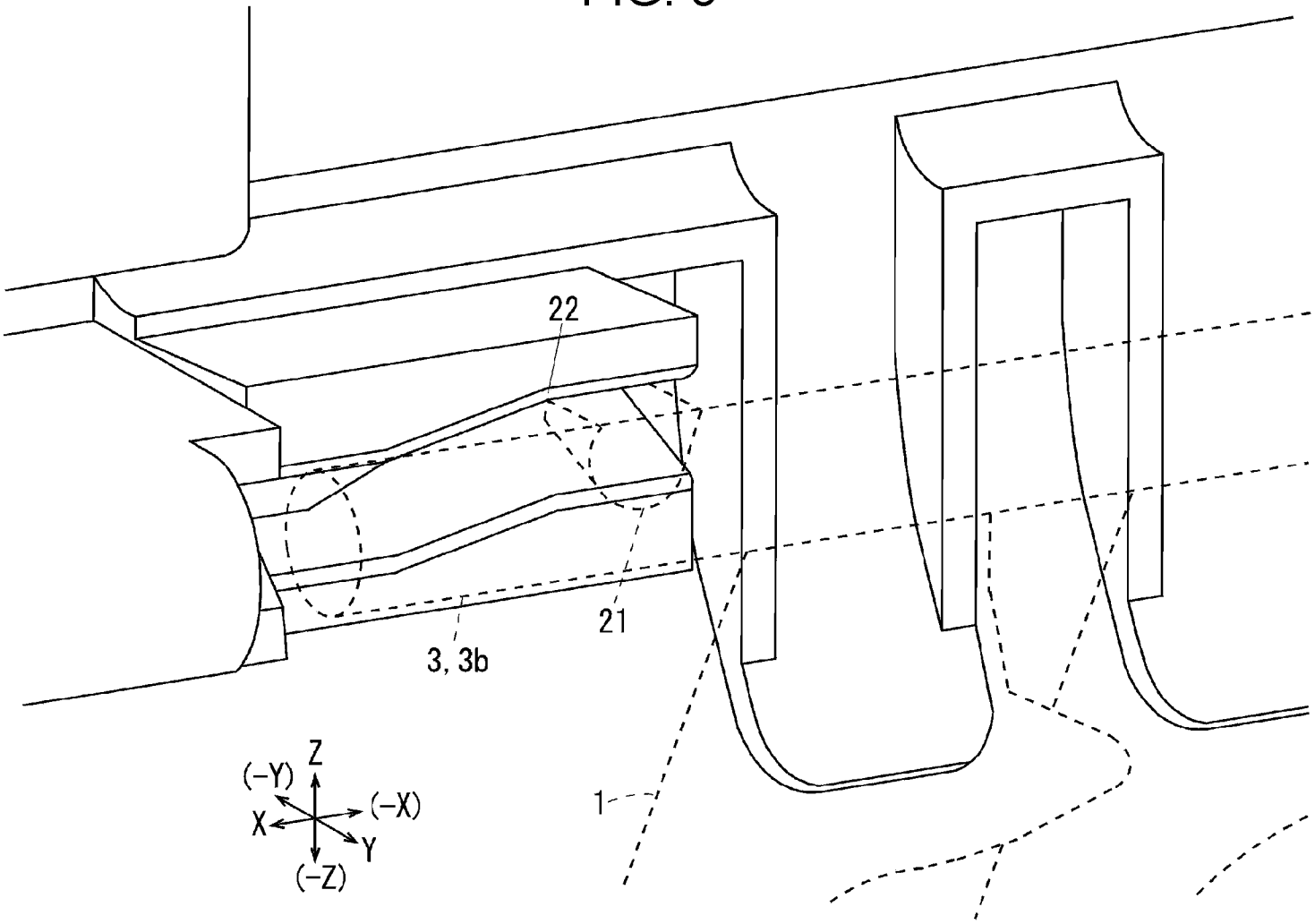
FIG. 5 illustrates a portion that operates a gate according to the example 1 at a second end in the width direction.

FIG. 5 illustrates a portion that operates the gate according to the example 1, and illustrates the second end in the width direction.

In FIG. 5, at the front of the front (facing to the second end) shaft 3*b*, a guide piece 21, which is an example of a guided member, is disposed. The guide piece 21 has a shape of a plate protruding leftward.

At a front portion of the frame Ua, a guide rail 22, which is an example of a guide member, is formed to correspond to the left side of the guide piece 21. The guide rail 22 is disposed above and below the guide piece 21, so that the guide piece 21 is clamped in the guide rail 22. Thus, the guide piece 21 is movable forward and rearward in the guide rail 22 along with the forward and rearward movements of the gate GT1. The guide rail 22 according to the example 1 helically extends to be inclined downward toward the front. Thus, the guide piece 21 guides the gate GT1 so that the gate GT1 rotates about the shafts 3 (3*a* and 3*b*) along with the forward and rearward movements of the guide piece 21.

The reversing rollers Rb, the gate GT1, the components denoted with signs 1 to 22 constitute a medium transport device according to the example 1.

OPERATIONS OF EXAMPLE 1

Figure 6A:
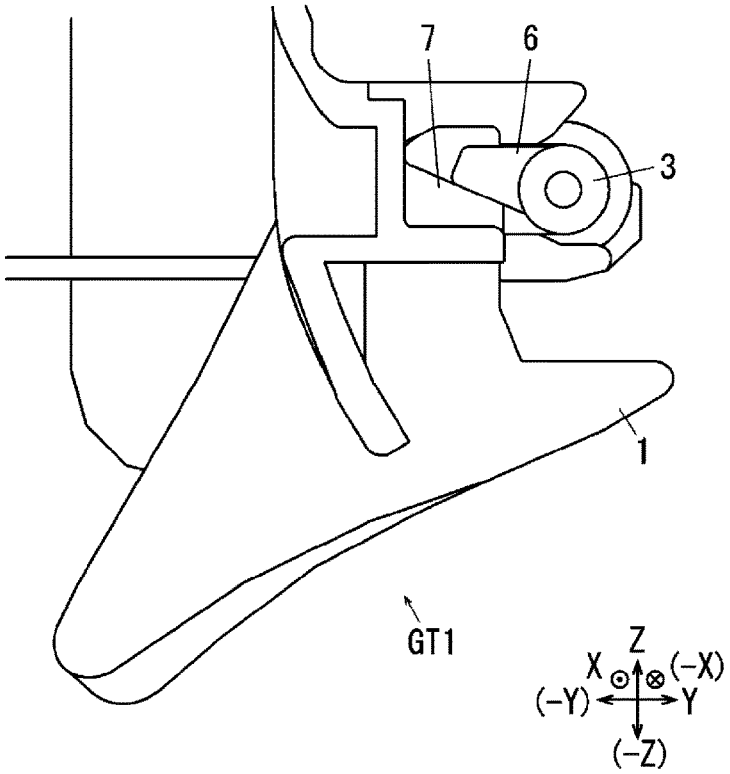
FIGS. 6A and 6B illustrate a gate according to the example 1, where
Figure 6B:
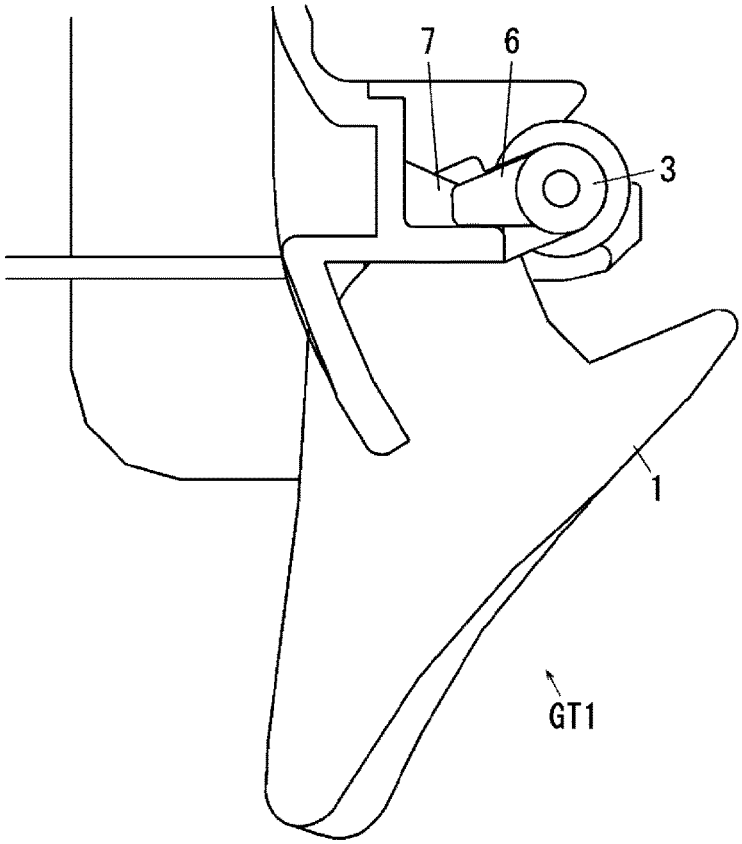

FIGS. 6A and 6B illustrate a gate according to an example 1, where FIG. 6A illustrates the gate in a first guide position, and FIG. 6B illustrates the gate in a second guide position.

In the copying machine U according to the example 1 having the above structure, to discharge the recording sheets S to the lower paper output tray TRh, the gate GT1 needs to move to the first guide position. Here, the solenoid 13 is held in the nonoperational state, and the gate GT1 is moved rearward (to the second shift position) with the force of the gate spring 12. Thus, the protruding portion 6 is located above the guide protrusion 7, and as illustrated in FIG. 6A, the gate GT1 is held in the first guide position. In this state, when the gate GT1 is to rotate toward the second guide position, the protruding portion 6 comes into contact with the guide protrusion 7 to prevent the gate GT1 from moving to the second guide position.

To discharge the recording sheets S to the upper paper output tray TRh2 or to perform double-side printing on the recording sheets S, the gate GT1 needs to move to the second guide position illustrated in FIG. 6B. Here, the solenoid 13 is in the operational state. Thus, the gate GT1 moves forward (to the first shift position). The protruding portion 6 is thus spaced apart from the guide protrusion 7. The gate GT1 is then become movable to the second guide position. Along with the forward movement of the gate GT1, the guide piece 21 rotates along the helical guide rail 22. Thus, the gate GT1 moves to the second guide position, as illustrated in FIG. 6B.

To transport the recording sheets S toward the reverse path SH6 for double-side printing, the gate GT1 needs to move to the first guide position. To transport the recording sheets S to the reverse path SH6, the solenoid 13 is switched from the operational state to the nonoperational state. Thus, the gate GT1 is moved rearward (to the second shift position) with the force of the gate spring 12. Along with the movement toward the gate GT1, the protruding portion 6 moves rearward while being in contact with the guide protrusion 7. Thus, the protruding portion 6 moves upward, and the gate GT1 rotates about the shafts 3. Here, the guide piece 21 is also moved rearward along the guide rail 22 and rotated around the shafts 3 by the helical guide rail 22. Thus, the gate GT1 is returned to the first guide position with the force of the gate spring 12.

In the medium transport device according to the example 1, the gate GT1 moves between the first guide position and the second guide position in association with the operation and the stop of operation of the solenoid 13. Particularly, the example 1 includes a set of the protruding portion 6 and the guide protrusion 7, and a set of the guide piece 21 and the guide rail 22 to convert the forward and rearward movements of the gate GT1 to the movement of the gate GT1 in the rotation direction (between the first guide position and the second guide position).

Here, either one of the set of the protruding portion 6 and the guide protrusion 7 and the set of the guide piece 21 and the guide rail 22, for example, only the guide piece 21 and the guide rail 22 may be used as members to convert the forward and rearward movements of the gate GT1 to the movement in the rotation direction (specifically, the shapes of the protruding portion 6 and the guide protrusion 7 or the positional relationship between them may not affect such a conversion function).

Here, the existing structure as described in Japanese Patent Application Publication No. 2017-119559 uses only the force of a spring to hold the gate in the first guide position according to the example 1. This is because, usually, discharging the recording sheets to the lower paper output tray in a single-side printing is more frequently performed than the double-side printing. Thus, the use of a spring is reasonable to hold the gate in the frequently used first guide position without electric power, and to move the gate to the second guide position with the operation of a driving source (with electric power) such as a motor or a solenoid for double-side printing, which is performed less frequently.

Here, in either the example 1 or the existing technology described in Japanese Patent Application Publication No. 2017-119559, to transport the recording sheets S toward the reverse path SH6, the recording sheets S transported rearward come into contact with the gate GT1 to be guided to the reverse path SH6. If the recording sheets S are stiff media, such as cardboard, such recording sheets S press the gate GT1 with a strong force. Particularly, the leading ends of the recording sheets S in the transport direction collide against the gate GT1 with a strong force.

In the existing technology for holding the gate in the first guide position with only a spring, the spring force may be insufficient and allow the gate to rotate if the gate receives a strong force from the recording sheet transported to the reverse path. When the gate rotates, the recording sheet may be transported rearward to the fixing device, instead of the reverse path, and may be guided erroneously.

Continuously operating a motor or using a highly elastic spring as a gate spring to transport a recording sheet to the reverse path to avoid erroneous guide may increase the running cost or manufacturing cost.

To avoid these, in the example 1, the protruding portion 6 and the guide protrusion 7 are held while being located close to each other when the gate GT1 is moved to the first guide position. Thus, when the gate GT1 is pressed by the recording sheet S to move toward the second guide position, the protruding portion 6 comes into contact with the guide protrusion 7 and blocks rotation of the gate GT1. The gate GT1 is thus prevented from moving from the first guide position, so that erroneous guide of the recording sheet S is prevented. Thus, in the example 1, erroneous guide of the recording sheets S is prevented without an increase in costs such as the running cost.

Particularly, in the example 1, the gate spring 12 simply exerts the force of moving the gate GT1 frontward and rearward without exerting the force of holding the gate GT1 in the first guide position. This structure is thus allowed to use a spring that is less expensive and has a weaker elastic force than a strong spring used in the existing technology for holding the gate in the first guide position with only the spring. This structure thus reduces the manufacturing cost.

The gate GT1 returns from the second guide position to the first guide position with the gate spring 12. Thus, in the example 1, returning the gate GT1 does not involve the electric power, thereby reducing the running cost. Particularly, the gate GT1 is allowed to be held in the frequently used first guide position without operating the solenoid 13. This structure thus reduces the running cost further than the structure that holds the gate by operating the solenoid 13.

In the example 1, the protruding portion 6 and the guide protrusion 7 have curved outer surfaces. If the protruding portion 6 and the guide protrusion 7 have flat outer surfaces, they are more likely to come into contact with each other over a wide area. Thus, a large frictional force is caused when the protruding portion 6 moves while being in contact with the guide protrusion 7, and the frictional force may prevent the protruding portion 6 from moving smoothly. In contrast, in the example 1, the protruding portion 6 and the guide protrusion 7 come into contact with each other over a small area, so that the protruding portion 6 smoothly moves relative to the guide protrusion 7 while being in contact with the guide protrusion 7.

In the example 1, the protruding portion 6 and the guide protrusion 7 are disposed on the rear side, and the guide piece 21 and the guide rail 22 are disposed on the front side. They are disposed on both sides of the gate GT1 in the longitudinal direction. They may be disposed on only one side. However, disposing them on only one side may bend or distort the gate GT1 that is long in the front-rear direction. Distortion of the gate GT1 may cause erroneous guide of the recording sheet S. The structure according to the example 1 prevents such error.

MODIFIED EXAMPLE

Thus far, the examples of the present disclosure have been descried in detail. However, the disclosure is not limited to the above-described examples, and may be modified in various manners within the scope of the gist of the present disclosure described in the scope of claims. Modified examples H01 to H04 of the present disclosure are described, below, by way of examples.

H01

In the above examples, the copying machine U has been described as an example of an image forming apparatus. The present disclosure is not limited to this, however. The image forming apparatus is applicable to a FAX machine, or a multifunctional printer having multiple functions such as a FAX machine, a printer, and a copying machine. The image forming apparatus is not limited to an electrophotographic image forming apparatus, and is applicable to an image forming apparatus of any image forming form such as ink jet printing, or photolithographic printing including thermal head printing. In addition, the image forming apparatus is not limited to an image forming apparatus for multi-color development, and may be an image forming apparatus for forming single-color or monochrome images.

H02

The above example has described a structure, by way of example, including the paper output trays TRh and TRh2 vertically arranged in two levels. However, the structure may include paper output trays arranged in three or more levels. The above example has described a structure, by way of example, including a medium transport device disposed in the printer unit U1. This is not the only possible structure, however. The disclosure is also applicable to a structure for a postprocessor including a transport path including a gate.

H03

The above example has described a structure, by way of example, including the solenoid 13 as an example of a driving source and the link 11 for transmitting a driving force. This is not the only possible structure, however. The disclosure is also applicable to a structure including, for example, a motor, a gear, a pinion, and a rack.

H04

The above example has described a structure, by way of example, including a set of the protruding portion 6 and the guide protrusion 7, which are disposed on the rear side, and a set of the guide piece 21 and the guide rail 22, which are disposed on the front side. This is not the only possible structure, however. The disclosure is also applicable to a structure including either one set. For example, the gate GT1 may rotate to the second guide position with its weight by changing the center of gravity of the gate GT1, or the shaft 3 may be made rotatable to the second guide position with a torsion spring disposed thereon to omit the guide piece 21 and the guide rail 22 on the front side.

Alternatively, the structure may omit the protruding portion 6 and the guide protrusion 7 on the rear side, since the gate GT1 is allowed to be held in the first guide position with a contact between the guide piece 21 and the guide rail 22 on the front side.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A medium transport device, comprising:

a transporting member that transports a medium toward a medium accommodating member;

a switching member that switches a direction to which the medium is transported between a first guide position, in which the switching member guides the medium to the medium accommodating member, and a second guide position, in which the switching member guides the medium to a position different from the medium accommodating member, the switching member being movable between a first shift position and a second shift position in a width direction of the medium; and a movement member that moves the switching member to the first guide position when the switching member moves to the first shift position, and that moves the switching member to the second guide position when the switching member moves to the second shift position.

2. The medium transport device according to claim 1, further comprising:

an urging member that urges the switching member toward the first guide position; and a driving member that moves the switching member to the second guide position against a force of the urging member.

3. The medium transport device according to claim 2, further comprising:

a guided member supported by the switching member; and a guide member inclined with respect to the width direction of the medium, the guide member guiding the guided member to move the switching member between the first guide position and the second guide position.

4. The medium transport device according to claim 3, wherein the movement member is disposed on a first end side in the width direction of the medium, and wherein the guided member and the guide member are disposed on a second end side in the width direction of the medium.

5. The medium transport device according to claim 1, further comprising:

a guided member supported by the switching member; and a guide member inclined with respect to the width direction of the medium, the guide member guiding the guided member to move the switching member between the first guide position and the second guide position.

6. The medium transport device according to claim 5, wherein the movement member is disposed on a first end side in the width direction of the medium, and wherein the guided member and the guide member are disposed on a second end side in the width direction of the medium.

7. An image forming apparatus, comprising:

an image forming member that forms an image on a medium; and the medium transport device according to claim 1 that transports a medium on which an image is formed by the image forming member.

8. A medium transport device, comprising:

a transporting member that transports a medium toward a medium accommodating member;

a switching member that switches a direction in which the medium is transported between a first guide position, in which the switching member guides the medium to the medium accommodating member, and a second guide position, in which the switching member guides the medium to a position different from the medium accommodating member, the switching member being movable between a first shift position and a second shift position in a width direction of the medium; and a movement member that includes a protruding member and a protruding contact member, the protruding member being supported by the switching member, the protruding contact member being supported by a frame of a medium transport device, the protruding contact member moving the switching member to the second guide position by coming into contact with the protruding member to move the switching member to the second shift position.

9. The medium transport device according to claim 8, wherein the protruding member has a curved outer surface, and wherein the protruding contact member has a curved outer surface.

10. The medium transport device according to claim 9, further comprising:

an urging member that urges the switching member toward the first guide position; and a driving member that moves the switching member to the second guide position against a force of the urging member.

11. The medium transport device according to claim 10, further comprising:

a guided member supported by the switching member; and a guide member inclined with respect to the width direction of the medium, the guide member guiding the guided member to move the switching member between the first guide position and the second guide position.

12. The medium transport device according to claim 11, wherein the movement member is disposed on a first end side in the width direction of the medium, and wherein the guided member and the guide member are disposed on a second end side in the width direction of the medium.

13. The medium transport device according to claim 9, further comprising:

a guided member supported by the switching member; and a guide member inclined with respect to the width direction of the medium, the guide member guiding the guided member to move the switching member between the first guide position and the second guide position.

14. The medium transport device according to claim 13, wherein the movement member is disposed on a first end side in the width direction of the medium, and wherein the guided member and the guide member are disposed on a second end side in the width direction of the medium.

15. The medium transport device according to claim 8, further comprising:

an urging member that urges the switching member toward the first guide position; and a driving member that moves the switching member to the second guide position against a force of the urging member.

16. The medium transport device according to claim 15, further comprising:

a guided member supported by the switching member; and a guide member inclined with respect to the width direction of the medium, the guide member guiding the guided member to move the switching member between the first guide position and the second guide position.

17. The medium transport device according to claim 16, wherein the movement member is disposed on a first end side in the width direction of the medium, and wherein the guided member and the guide member are disposed on a second end side in the width direction of the medium.

18. The medium transport device according to claim 8, further comprising:

a guided member supported by the switching member; and a guide member inclined with respect to the width direction of the medium, the guide member guiding the guided member to move the switching member between the first guide position and the second guide position.

19. The medium transport device according to claim 18, wherein the movement member is disposed on a first end side in the width direction of the medium, and wherein the guided member and the guide member are disposed on a second end side in the width direction of the medium.

* * * * *